US010633059B1

(12) United States Patent
Elliott

(10) Patent No.: US 10,633,059 B1
(45) Date of Patent: Apr. 28, 2020

(54) WATERCRAFT-MOUNTED PERSONAL LIFTING DEVICE

(71) Applicant: Peter Elliott, Rosetown (CA)

(72) Inventor: Peter Elliott, Rosetown (CA)

( * ) Notice: Subject to any disclaimer, the term of this patent is extended or adjusted under 35 U.S.C. 154(b) by 0 days.

(21) Appl. No.: 16/193,450

(22) Filed: Nov. 16, 2018

(51) Int. Cl.

| | |
|---|---|
| ***B63B 27/14*** | (2006.01) |
| ***B63B 27/16*** | (2006.01) |
| ***B63B 27/36*** | (2006.01) |
| ***B63B 27/08*** | (2006.01) |

(52) U.S. Cl.
CPC ..... *B63B 27/14* (2013.01); *B63B 27/08* (2013.01); *B63B 27/16* (2013.01); *B63B 27/36* (2013.01)

(58) Field of Classification Search
CPC ..... B63B 27/00; B63B 27/14; B63B 27/16; B63B 27/36; B63B 17/00; B66B 9/00; A61G 3/00; A61G 3/06; A61G 3/062; E04G 3/00
USPC ..... 114/362
See application file for complete search history.

(56) References Cited

U.S. PATENT DOCUMENTS

| | | | | |
|---|---|---|---|---|
| 2,998,148 | A | 8/1961 | Himel, Jr. | |
| 4,115,887 | A * | 9/1978 | Ewards | B63B 27/14 114/362 |
| 4,412,598 | A | 11/1983 | Kimon et al. | |
| 4,984,955 | A | 1/1991 | McCullough | |
| 5,160,286 | A | 11/1992 | Hill | |
| 5,435,260 | A * | 7/1995 | Granie | B63B 1/12 114/362 |
| 5,709,154 | A | 1/1998 | Schott | |
| 7,618,223 | B1 | 11/2009 | Begley | |
| 8,056,496 | B1 * | 11/2011 | Bussa | B63B 27/146 114/362 |
| 9,643,689 | B1 | 5/2017 | McKenzie | |
| 9,670,037 | B2 | 6/2017 | Morice, III et al. | |
| 9,708,038 | B2 | 7/2017 | Imel et al. | |
| 2005/0081775 | A1 * | 4/2005 | Blank | B63B 27/143 114/362 |
| 2005/0160962 | A1 * | 7/2005 | Wright | B63B 27/143 114/362 |
| 2018/0369044 | A1 * | 12/2018 | Lyckestig | B66C 23/48 |

* cited by examiner

*Primary Examiner* — Lars A Olson

(74) *Attorney, Agent, or Firm* — Cramer Patent & Design, PLLC; Aaron R. Cramer

(57) ABSTRACT

A watercraft-mounted personal lifting device includes a remotely-operated arm in mechanical communication with a motor at a first end and a platform at a second end. Upon activation, the arm is configured to selectively raise or lower the platform. The platform is configured to accommodate a wheelchair and user thereby enabling the wheelchair and user to enter or exit the watercraft.

14 Claims, 5 Drawing Sheets

WATERCRAFT-MOUNTED PERSONAL LIFTING DEVICE

FIELD OF THE INVENTION

The present invention relates to a watercraft-mounted personal lifting device.

BACKGROUND OF THE INVENTION

Boating is a pleasurably activity enjoyed by people all over the world. Whether on a lake, river or ocean, many people regard boating as an essential part of their ideal vacation or relaxation time.

In fact, boating is so popular that it is popular with people of all walks of life and backgrounds. However, should the boating enthusiast be disabled, the act of participating may prove needlessly challenging if not altogether impossible. This is almost certainly so when a disabled individual is looking to board or disembark a boat without assistance from anyone else. In the past, some efforts having been made to address this issue such as U.S. Pat. No. 7,618,233 to Begley, U.S. Pat. No. 2,998,148 to Himel and U.S. Pat. No. 9,670,037 to Morice et al. These efforts however are somewhat cumbersome and fail to solve the problem in an efficient and practical manner.

Accordingly, there exists a need for a watercraft-mounted personal lifting device that assists a disabled individual in a manner which is safe and cost effective. The lifting device of the instant application provides such a solution.

SUMMARY OF THE INVENTION

The inventor has recognized the aforementioned inherent problems and lack in the art and observed that there is a need for an a lift access platform installed on a pontoon boat, having a platform which is located at the stern of the pontoon boat on the port side. When the platform is in an outboard position, a lifting arm assembly pivots about an attachment point along a first movement path to lower the platform but keep in a horizontal position due to paralleling properties of a first arm segment and a second arm segment. The lift access also provides a pivot point which allows the platform to pivot outboard through an arc of ninety degrees as depicted by a second movement path placing the platform adjacent outboard of the pontoon boat, a winch cable which is connected to the arm segments to provide mechanical force to raise and lower the lift access platform and a winch controller which is used to control a winch motor reel. The winch controller is a pendant-style controller to allow for operation both on and off of the pontoon boat.

The first movement path may be five feet in length. The attachment point is physically connected to a deck, the pontoon boat, or a structural member of the pontoon boat. The platform may be rectangular and is provided with two incline ramps at opposing sides and a pair of lips at other opposing sides. The ramps and the lips exist to make transition on and off the platform easier, when loading or unloading the pontoon boat when it is on top of a transport trailer. The platform is attached to the pivot point via an "L"-shaped tube, whose one segment is centrally positioned under the platform for stability. The winch motor reel is powered from a suitable power supply including an engine electrical system, a separate deep cycle battery, or an on-board generator.

The lift access may also provide a support handle to allow for steadying support of an individual during raising and lowering and/or a clear area on the deck is needed to pivot the platform on and off into an outboard condition. The lift access platform may be installed as standard equipment, optional equipment, or aftermarket equipment on a wide variety of various makes and models of the pontoon boat.

Placement of the lift access platform at the bow of the starboard side would work equally well. The lift access platform allows for operation when the pontoon boat is in water or out of water and may be made of aluminum or stainless steel. The lift access platform may be utilized while the pontoon boat is on a transport trailer, docked, anchored in clear water, or anywhere except while in motion for safety purposes.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
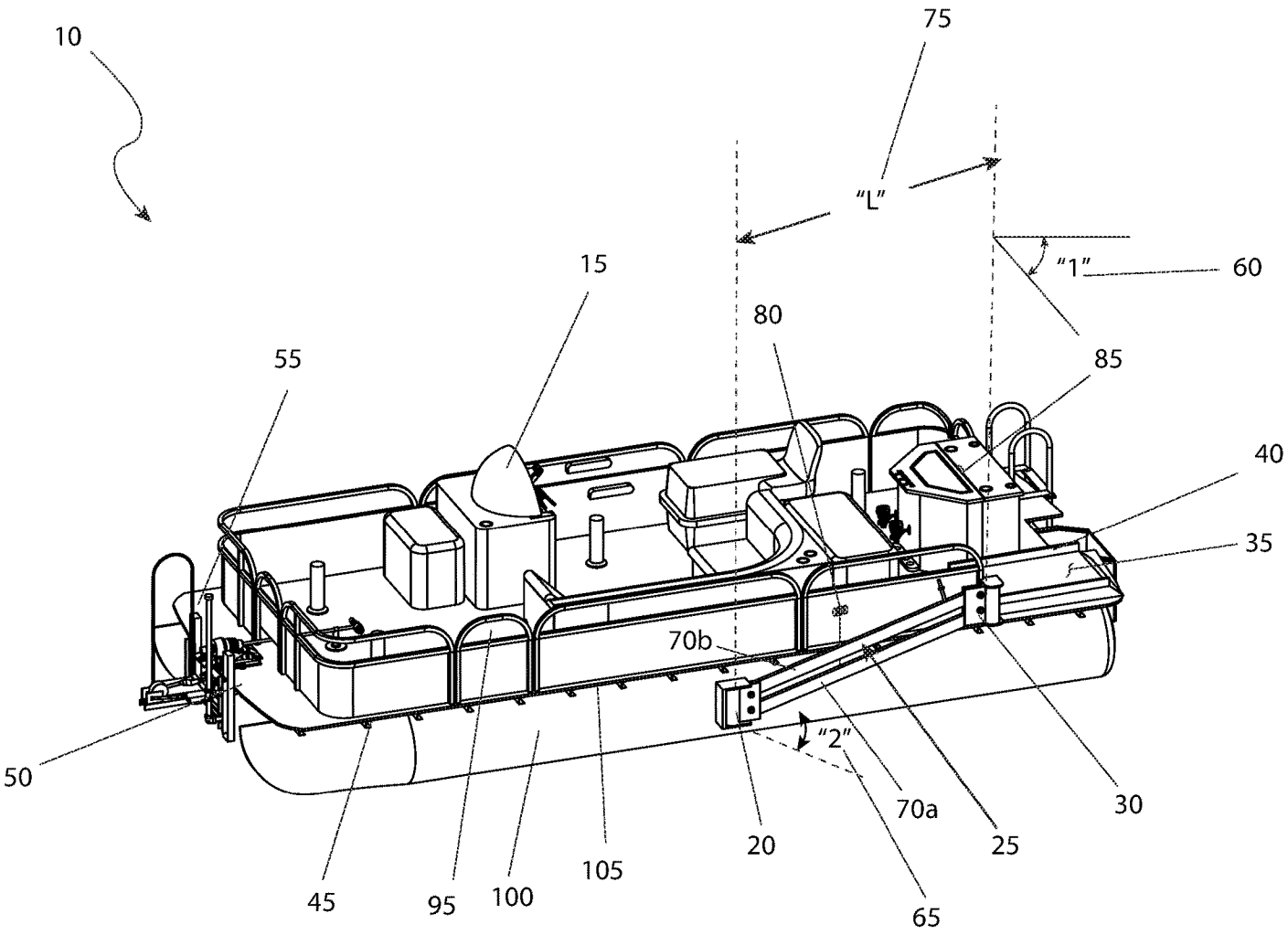
FIG. 1 is a perspective view of the lift access platform 10 installed on a pontoon boat 15, according to the preferred embodiment of the present invention.

10 lift access platform
15 pontoon boat
20 attachment point
25 lifting arm assembly
30 pivot point
35 platform
40 stern
45 port side
50 bow
55 starboard side
60 movement path "1"
65 movement path "2"
70*a* first arm segment
70*b* second arm segment
75 length "l"
80 winch cable
85 winch controller
90 winch motor reel
95 deck
100 pontoon
105 structural member
110 incline ramp
111 lip
115 "L"-shaped tube
120 overall travel depth "d"
125 support handle
130 deck obstructions
135 bearing pin

140 hull
145 seat

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. DETAILED DESCRIPTION OF THE FIGURES

Referring now to FIG. 1, a perspective view of the lift access platform for pontoon boat 10, installed on a pontoon boat 15, according to the preferred embodiment of the present invention is disclosed. The lift access platform 10 (herein also described as the "device") 10, includes primarily of an attachment point 20, a lifting arm assembly 25, a pivot point 30, and a platform 35. Each of these components will be described in greater detail herein below. The device 10 can be installed as either standard equipment, optional equipment, or aftermarket equipment on a wide variety of various makes and models of pontoon boat 15. The various representations presented in the multiple figures herein of the present invention is intended for illustrative purposes only and is not intended to limit the claims of the present invention. It is understood by those skilled in the art that various modifications to the device 10 and/or the pontoon boat 15 will be necessary to accommodate the teachings contained herein. Any such modifications including but not limited to: dimensions, material, relative configuration, and finishes are not intended to limit the claims of the present invention.

The platform 35 is located at the stern 40 of the pontoon boat 15 on the port side 45 for purposes of illustration. It is understood that placement of the device 10 at the bow 50 of the starboard side 55 would work equally well. Additionally, the device 10 could be configured in a mirror configuration of FIG. 1 and be placed in opposite corners as those previously described. The platform 35 is shown in a stowed position on the pontoon boat 15 in FIG. 1. The pivot point 30 allows the platform 35 to pivot outboard through an arc of ninety degrees (90°) as depicted by movement path "1" 60 thus placing the platform 35 adjacent but outboard of the pontoon boat 15. When the platform 35 is in an outboard position, the lifting arm assembly 25 may then pivot about the attachment point 20 along a movement path "2" 65 to lower the platform 35 but keep it in a horizontal position due to the paralleling properties of a first arm segment 70*a* and a second arm segment 70*b*. The overall amount of movement path "2" 65 is envisioned to be governed by the length "l" 75 of the arm segments 70*a*, 70*b*. A typical length "l" 75 is envisioned to be approximately five (5) feet in length, although other dimensions, both larger and smaller, could be utilized with equal success. As such, the present invention is not limited with regard to the exact dimension of the length "l" 75.

A winch cable 80 connected to the arm segments 70*a*, 70*b* is used to provide the mechanical force to raise and lower the device 10. A winch controller 85 is used to control the winch motor reel 90 (not shown in present figure due to illustrative limitations). The winch controller 85 is depicted as a pendant-style controller to allow for operation both on and off of the pontoon boat 15. However, it is noted that other locations and styles of controllers, such as wireless, cockpit-operated, voice-operated, and the like may be used with equal success, and as such, the type/location of the winch controller 85 is not intended to be a limiting factor of the present invention.

The attachment point 20 is physically connected to the deck 95, pontoon 100, or structural member 105 of the pontoon boat 15 via various methods such as bolting, welding or the like as required and necessary by the constraints of the various makes and models of pontoon boat 15. It is envisioned that all major components of the device 10 would be made of suitable metal material such as aluminum, stainless steel, or the like, such that it is impervious to corrosion factors of the environment in which it is used. It is noted that the device 10 allows for operation when the pontoon boat 15 is in the water or out of the water such as while on a transport trailer or the like.

Figure 2:
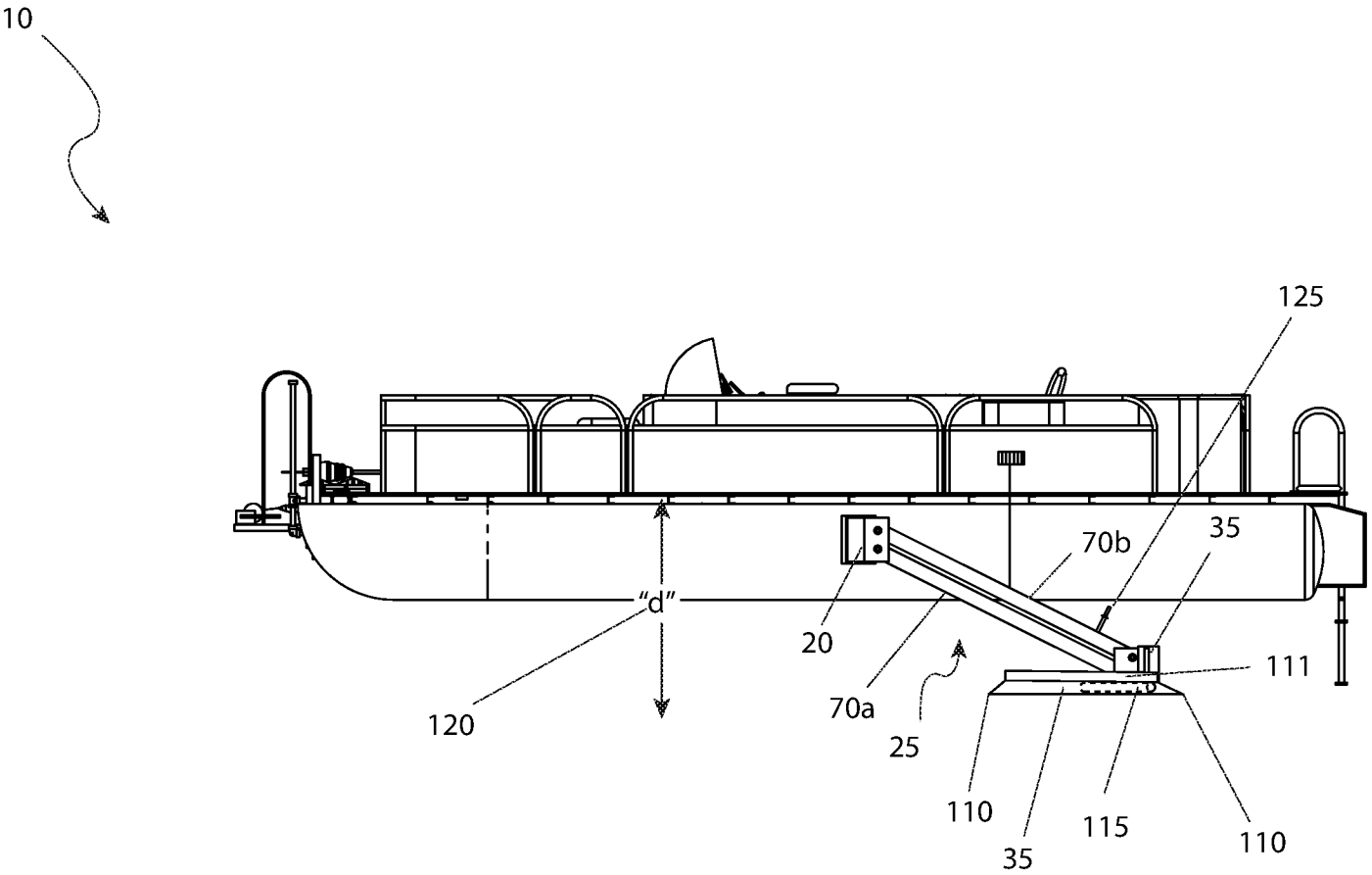
FIG. 2 is a side view of the lift access platform 10, shown in a lowered state, according to the preferred embodiment of the present invention.

Referring next to FIG. 2, a side view of the device 10, shown in a lowered state, according to the preferred embodiment of the present invention is depicted. The platform 35 is preferentially rectangular and is provided with two (2) incline ramps 110 at opposing sides and a pair of lips 11 at the other opposing sides. The ramps 110 and lips 111 exist to make transition on and off the platform 35 easier, such as for hand trucks, wheeled carts, wheelchairs, and the like, such as when loading/unloading the pontoon boat 15 when it is on top of a transport trailer. The platform 35 is attached to the pivot point 30 via an "L"-shaped tube 115, whose one (1) segment is centrally positioned under the platform 35 for stability. As aforementioned described the overall performance parameters of the device 10 is envisioned to be governed by the overall configuration of the device 10. However, typical performance parameters are envisioned to provide an overall travel depth "d" 120 approximately three to four feet (3-4 ft.). A support handle 125 is provided to allow for steadying support of an individual during the raising and lowering process.

Figure 3:
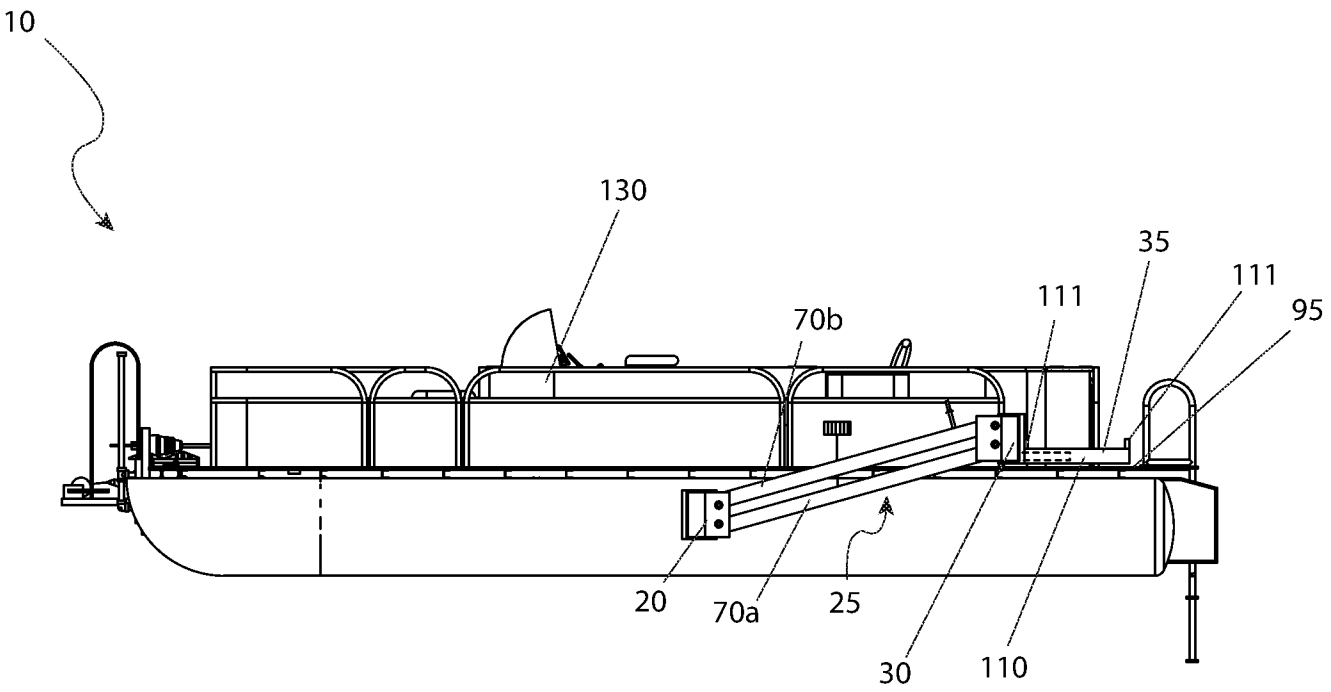
FIG. 3 is a side view of the lift access platform 10, shown in a raised state, according to the preferred embodiment of the present invention.

Referring now to FIG. 3, a side view of the device 10, shown in a raised state, according to the preferred embodiment of the present invention is shown. The device 10 presents an overall low-profile design that can be adapted to any make or model of pontoon boat 15. It is noted that a clear area on the deck 95 is needed to pivot the platform 35 on and off into an outboard condition. Any deck obstructions 130 such as railings, guardrails, seats, stowage compartments, and the like, would need to be either permanently or temporarily relocated. Additionally, a clear area on the interior of the pontoon boat 15 would be needed for the winch motor reel 90 (not shown in this figure). The functionality of the device 10 may be utilized while the pontoon boat 15 is on a transport trailer, docked, anchored in clear water, or virtually anywhere except while in motion for safety purposes.

Figure 4:
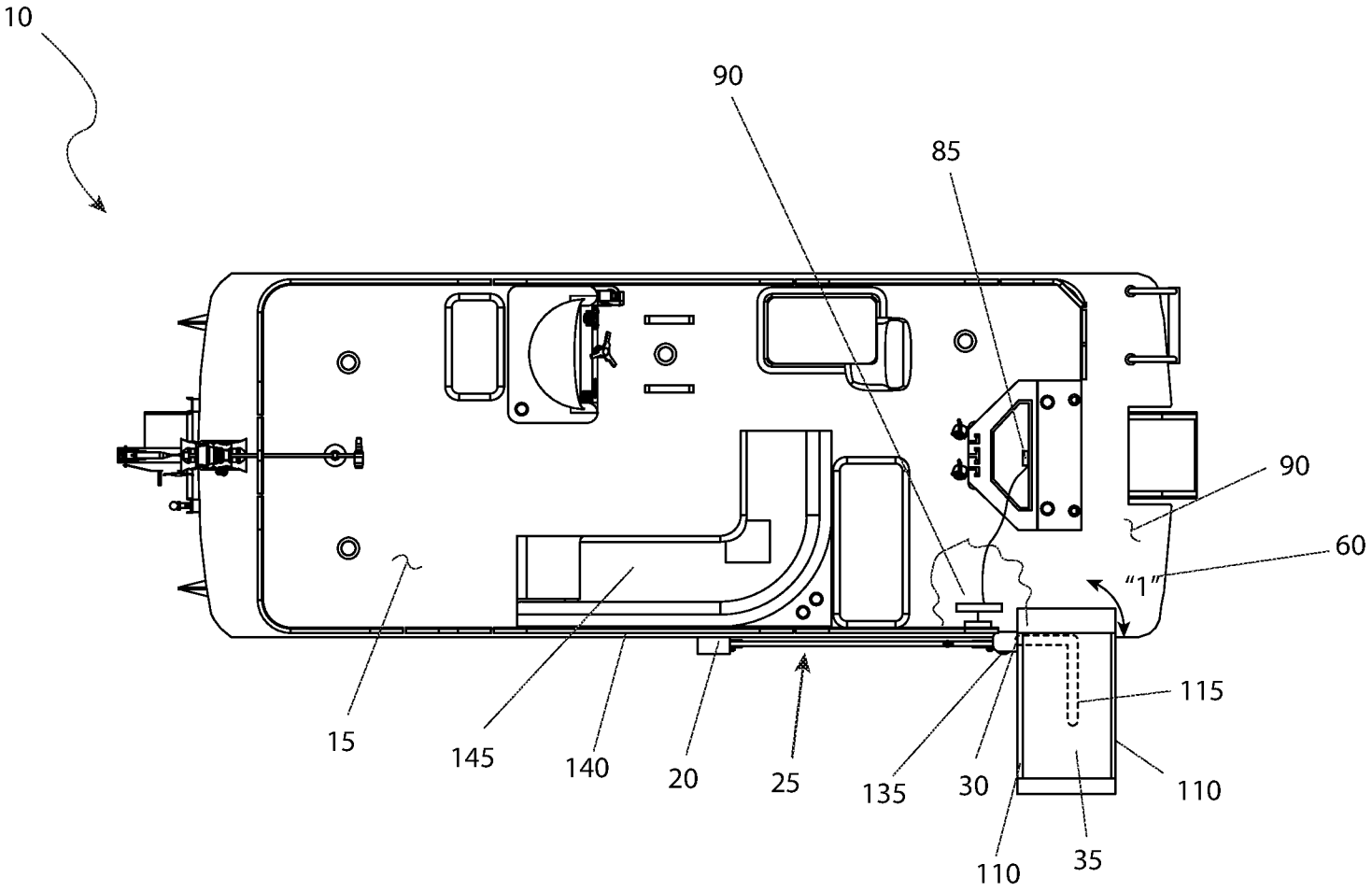
FIG. 4 is a top view of the lift access platform 10, shown in an outboard state, according to the preferred embodiment of the present invention; and, FIG. 5 is a top view of the lift access platform 10, shown in an inboard state, according to the preferred embodiment of the present invention.

Referring next to FIG. 4, a top view of the device 10, shown in an outboard state, according to the preferred embodiment of the present invention is disclosed. It is noted that the attachment point 20, the lifting arm assembly 25, the pivot point 30 and the platform 35 are clearly visible. The platform 35 is rotated outboard along the movement path "1" 60 about a bearing pin 135 that connects the "L"-shaped tube 115 to the pivot point 30. As such, as the device 10 is raised and lowered (as shown in FIG. 2), all raising and lowering components of the device 10 are clear of the hull 140 and deck 95 areas. The only deck 95 area occupied by the device 10 is that under the platform 35, and as such, the addition and usage of the device 10 is envisioned to have very little to no effect on the overall operation of the pontoon boat 15. The winch motor reel 90 is visible via a hidden view cutout lines. As depicted here, the winch motor reel 90 is located underneath a seat 145, although it can be very easily located in stowage compartment, cabinet, locker or open area depending on the make and model of the pontoon boat 15, and as such, the present configuration should not be interpreted as a limiting factor of the present invention. The winch motor reel 90 would be powered from a suitable power supply including but not limited to the engine electrical system, separate deep cycle battery, on-board generator, or the like.

Figure 5:
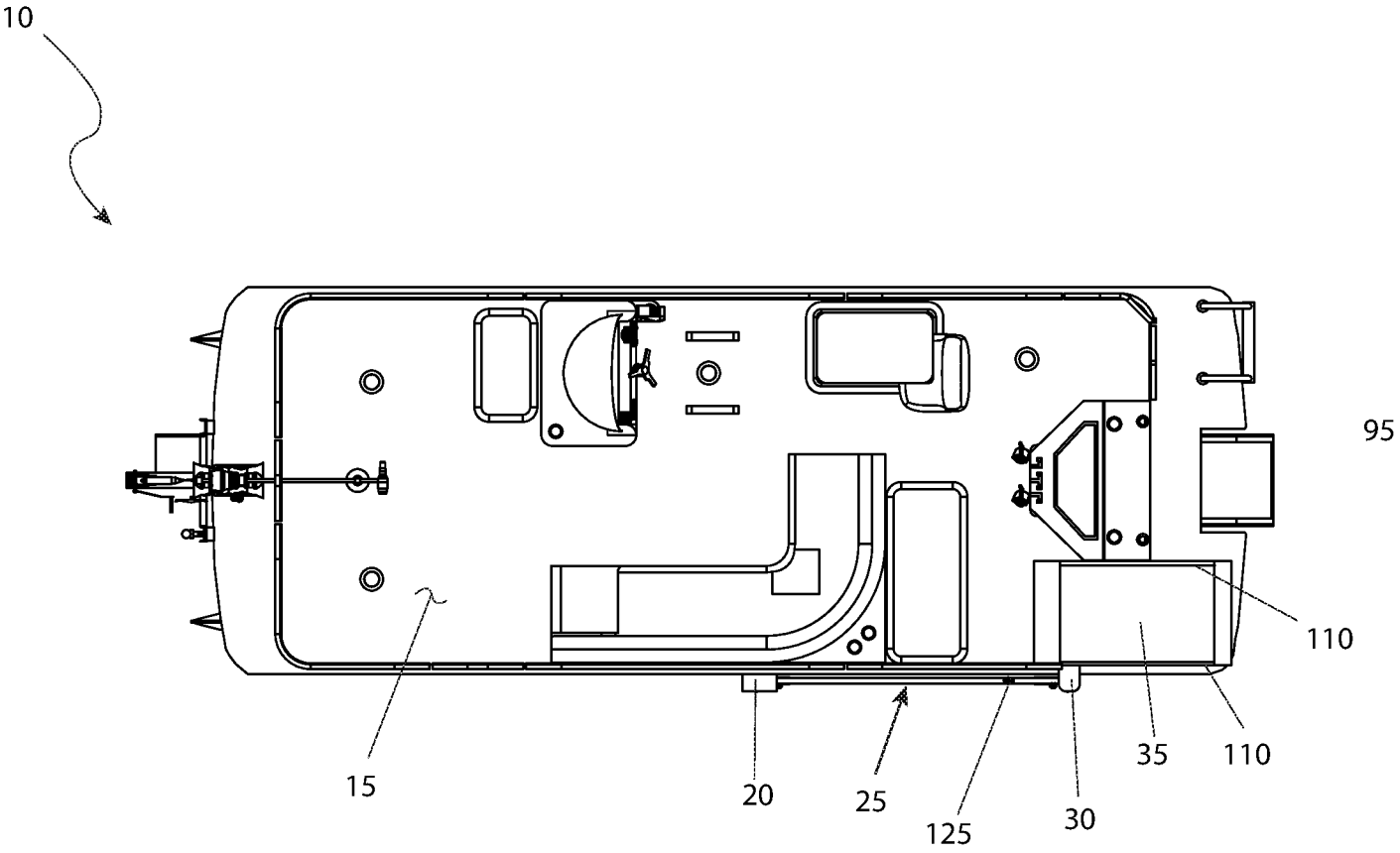

Referring finally to FIG. 5, a top view of the device 10, shown in an inboard state, according to the preferred embodiment of the present invention is depicted. This figure clearly depicts the platform 35 in a stowed position on the deck 95 of the pontoon boat 15, after completing the transition along the movement path "1" 60 as shown in FIG. 4. The mechanical force necessary to perform said movement is envisioned to be provided by a user via hand or foot motion. Should the user be atop the platform 35, simple rotational pressure by their feet in relation to their hand holding the support handle 125 is applied. Other situations such as when cargo is being loaded will require the assistance of a user either on the deck 95 pulling the platform 35 onboard, or a user outboard of the pontoon boat 15 pushing the platform 35 onboard. It is envisioned that the device 10 would have a weight limit capacity of at least three hundred pounds (300 lbs.).

2. OPERATION OF THE PREFERRED EMBODIMENT

One of favorite type of boats for basic general boating is that of the pontoon boat. They have many benefits especially when large amounts of people are involved. They have plenty of room for entire families and friends. They also have a large amount of storage space for things like ice chests, food, towels, tackle, personal bags, and the like. They are easily to pilot, have a relatively low draft for shallow locations, and are almost impossible to tip over as people move or walk around. However, pontoon boats suffer from the fact that they are somewhat for passengers to get in and out of the water. Since many pontoon boat passengers or operators may be elderly or disabled due to their very accommodating nature, the egress difficulty is especially notable Should the boat be on a transport trailer the ability to get people and supplies in and out of it is almost impossible, even for the most athletic of users. Accordingly, there exists a need for a means by which access on and off pontoon boats can be more easily achieved whether the boat is on a trailer or in the water. The development of the lift access platform for pontoon boat 10 fulfills this need.

The preferred embodiment of the present invention can be utilized by the common user in a simple and effortless manner with little or no training. It is envisioned that the device 10 would be constructed in general accordance with FIG. 1 through FIG. 5. The user would procure the device 10 either as an aftermarket add-on component or as standard or optional equipment on a new pontoon boat 15. Particular attention would be paid to the interface of the attachment point 20 to the structural member 105, the deck 95 and the hull 140 with the likelihood of specific adapters being needed for each specific make and model of pontoon boat 15.

After procurement and prior to utilization, the device 10 would be prepared in the following manner: the attachment point 20 would be connected to the structural member 105, the deck 95, and the hull 140 as required; the lifting arm assembly 25 would be connected to the lifting arm assembly 25, along with the pivot point 30, the "L"-shaped tube 115 and the platform 35; the winch motor reel 90 would be installed in a suitable location; the winch cable 80 would be connected to the lifting arm assembly 25; the winch motor reel 90 would be connected to a suitable electrical power source; the winch controller 85 would be located for easy access either onboard or off of the pontoon boat 15; and final operational checks would be performed.

During utilization of the device 10, the following procedure would be initiated: to lower users or cargo from the pontoon boat 15; said objects would be placed upon the platform 35; the platform 35 rotated to an outboard position using physical force as shown in FIG. 4; the winch controller 85 would be operated to energize the winch motor reel 90 and lower the platform 35, either while the pontoon boat 15 is in the water or out of the water. To raise the platform 35, this process would be reversed.

After use of the device 10, it is left in a stowed position as shown in FIG. 5. Normal maintenance such as cleaning, lubrication and replacement of worn parts would be required.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A lift access platform installed on a pontoon boat, comprising:

a platform located at a stern of said pontoon boat on a port side, when said platform is in an outboard position, a lifting arm assembly pivots about an attachment point along a first movement path to lower said platform but keep in a horizontal position due to paralleling properties of a first arm segment and a second arm segment;

a pivot point allowing said platform to pivot outboard through an arc of ninety degrees as depicted by a second movement path placing said platform adjacent outboard of said pontoon boat;

a winch cable connected to said arm segments to provide mechanical force to raise and lower said lift access platform;

a winch controller used to control a winch motor reel, said winch controller is a pendant-style controller to allow for operation both on and off of said pontoon boat and, wherein said platform is rectangular and is provided with two incline ramps at opposing sides and a pair of lips at other opposing sides.

2. The lift access platform according to claim 1, wherein said first movement path is five feet in length.

3. The lift access platform according to claim 1, wherein said attachment point is physically connected to a deck, said pontoon boat, or a structural member of said pontoon boat.

4. The lift access platform according to claim 1, wherein said ramps and said lips exist to make transition on and off said platform easier, when loading or unloading said pontoon boat when it is on top of a transport trailer.

5. The lift access platform according to claim 1, wherein said platform is attached to said pivot point via an L-shaped tube, whose one segment is centrally positioned under said platform for stability.

6. The lift access platform according to claim 1, wherein said winch motor reel is powered from a suitable power supply including an engine electrical system, a separate deep cycle battery, or an on-board generator.

7. The lift access platform according to claim 1, further comprising a support handle provided to allow for steadying support of an individual during raising and lowering.

8. The lift access platform according to claim 1, further comprising a clear area on said deck is needed to pivot said platform on and off into an outboard condition.

9. The lift access platform according to claim 1, wherein said lift access platform is installed as standard equipment, optional equipment, or aftermarket equipment on a wide variety of various makes and models of said pontoon boat.

10. The lift access platform according to claim 1, wherein placement of said lift access platform at said bow of said starboard side would work equally well.

11. The lift access platform according to claim 1, wherein said lift access platform allows for operation when the pontoon boat is in water or out of water.

12. The lift access platform according to claim 1, wherein said lift access platform is made of aluminum.

13. The lift access platform according to claim 1, wherein said lift access platform is made of stainless steel.

14. The lift access platform according to claim 1, wherein functionality of said lift access platform utilized while said pontoon boat is on a transport trailer, docked, anchored in clear water, or anywhere except while in motion for safety purposes.

* * * * *